US010220978B1

(12) United States Patent
Vicari

(10) Patent No.: US 10,220,978 B1
(45) Date of Patent: Mar. 5, 2019

(54) SEPARABLE FOOD CONTAINER

(71) Applicant: Dominic Vicari, Clarkston, MI (US)

(72) Inventor: Dominic Vicari, Clarkston, MI (US)

( * ) Notice: Subject to any disclaimer, the term of this patent is extended or adjusted under 35 U.S.C. 154(b) by 47 days.

(21) Appl. No.: 15/296,384

(22) Filed: Oct. 18, 2016

(51) Int. Cl.
*B65D 21/032* (2006.01)
*B65D 21/02* (2006.01)
*B65D 41/32* (2006.01)
*B65D 85/62* (2006.01)

(52) U.S. Cl.
CPC ..... *B65D 21/0224* (2013.01); *B65D 41/32* (2013.01); *B65D 85/62* (2013.01)

(58) Field of Classification Search
CPC ..... B65D 41/48; B65D 41/32; B65D 85/62; B65D 21/0224; B65D 21/0209
USPC ..... 220/4.27, 612; 229/101.1, 101.2
See application file for complete search history.

(56) References Cited

U.S. PATENT DOCUMENTS 1,815,800 A 7/1931 Respess
3,168,234 A 2/1965 Bartz
3,343,746 A 9/1967 Shiffman
4,091,929 A 5/1978 Krane
4,535,904 A * 8/1985 O'Connor ..... B65D 41/48 215/215
4,762,233 A 8/1988 Sears
5,626,250 A 5/1997 Dorazio
2,852,179 A1 5/2016 Skubic
2010/0043359 A1* 2/2010 Skiffington ..... B65D 83/0011 53/471
2011/0049154 A1* 3/2011 Michalsky ..... B65D 11/02 220/288

* cited by examiner

*Primary Examiner* — Stephen Castellano
(74) *Attorney, Agent, or Firm* — Kyle A. Fletcher, Esq.

(57) ABSTRACT

The separable food container is a cylindrical device that is adapted for use in storing a foodstuff. The separable food container comprises a first tube, a second tube and a fastener. The fastener attaches the first tube and the second tube such that the first tube and the second tube are separable. The advantage of separating the first tube from the second tube is such that when a portion of the foodstuff has been removed, the fastener can be removed thereby separating the first tube from the second tube. By removing the portion of the separable food container that no longer contains a foodstuff, access to the remaining foodstuff stored within the separable food container is simplified. The separable food container comprises a first tube, a second tube, a fastener, a first cap and a second cap.

12 Claims, 3 Drawing Sheets

SEPARABLE FOOD CONTAINER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of conveying, packing, storing, and transporting goods, more specifically, a container formed from two or more rigid components wherein the components are formed from metal, plastic, paper, or some combination thereof.

SUMMARY OF INVENTION

The separable food container is a cylindrical device that is adapted for use in storing a foodstuff. The separable food container comprises a first tube, a second tube and a fastener. The fastener attaches the first tube and the second tube such that the first tube and the second tube are separable. The advantage of separating the first tube from the second tube is such that when a portion of the foodstuff has been removed, the fastener can be removed thereby separating the first tube from the second tube. By removing the portion of the separable food container that no longer contains a foodstuff, access to the remaining foodstuff stored within the separable food container is improved.

These together with additional objects, features and advantages of the separable food container will be readily apparent to those of ordinary skill in the art upon reading the following detailed description of the presently preferred, but nonetheless illustrative, embodiments when taken in conjunction with the accompanying drawings.

In this respect, before explaining the current embodiments of the separable food container in detail, it is to be understood that the separable food container is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the separable food container.

It is therefore important that the claims be regarded as including such equivalent construction insofar as they do not depart from the spirit and scope of the separable food container. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
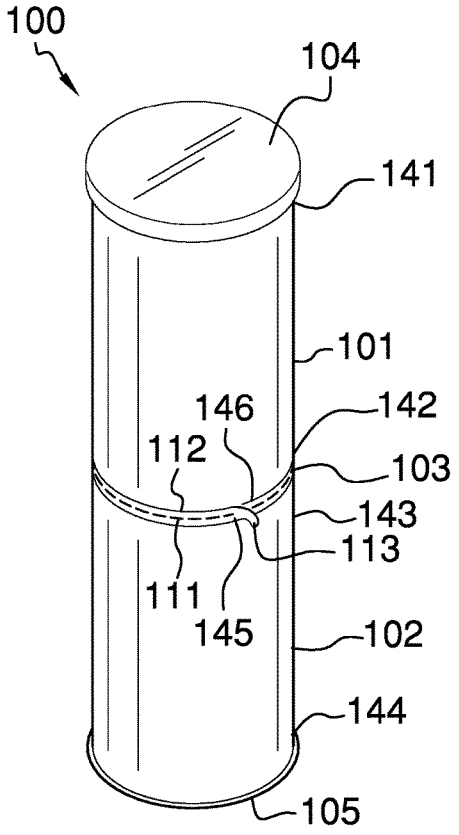
FIG. 1 is a perspective view of an embodiment of the disclosure.
Figure 2:
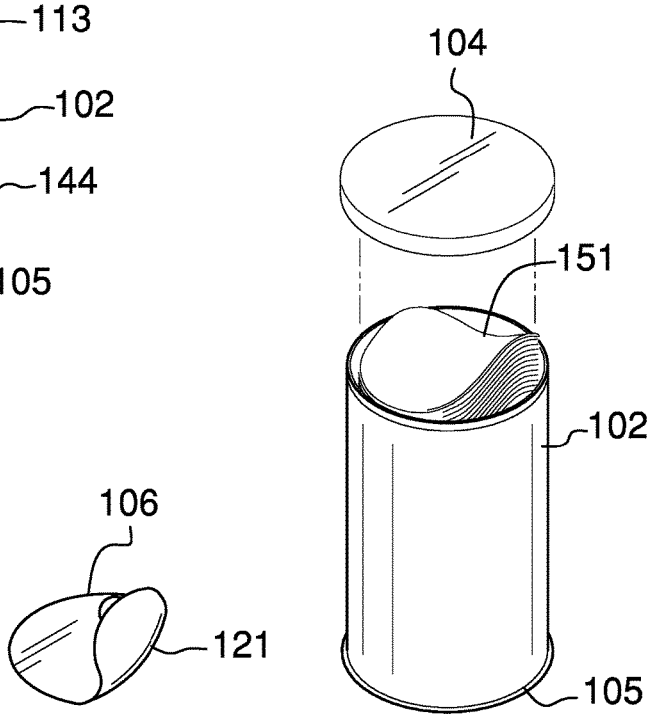
FIG. 2 is a detail view of an embodiment of the disclosure.
Figure 3:
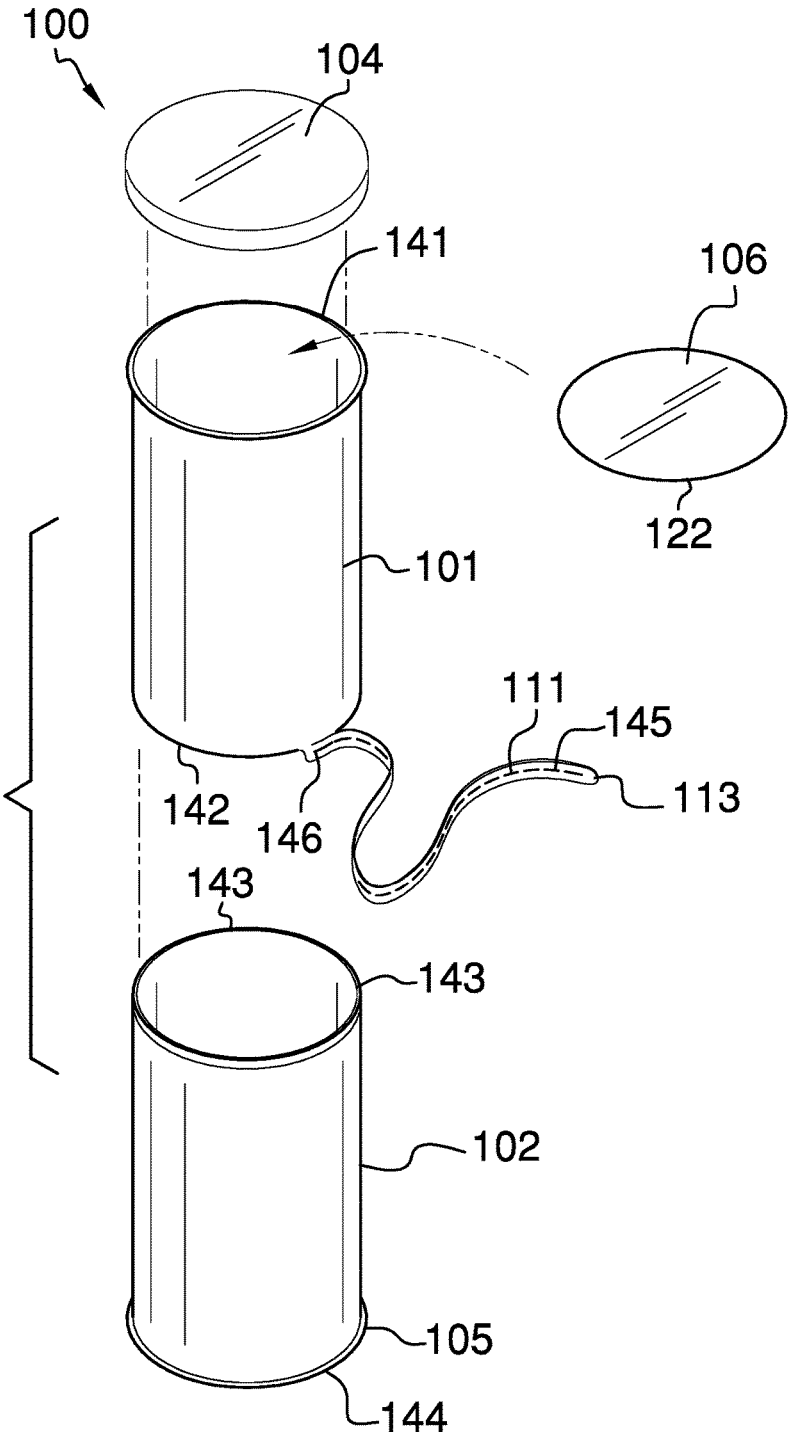
FIG. 3 is an exploded view of an embodiment of the disclosure.
Figure 4:
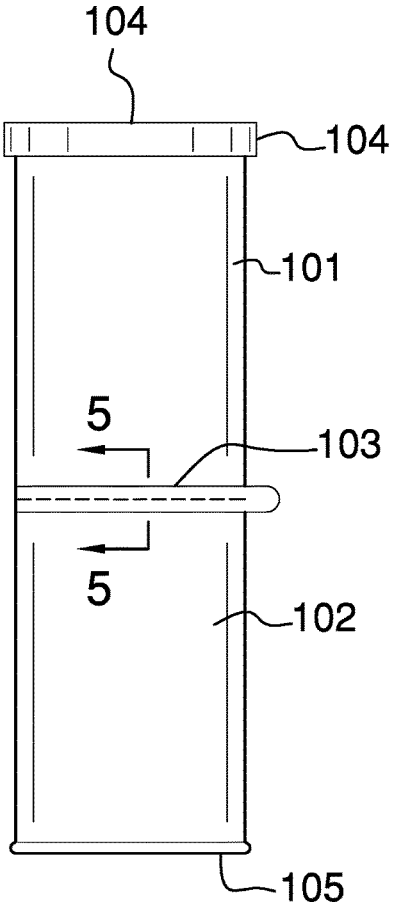
FIG. 4 is a side view of an embodiment of the disclosure.
Figure 5:
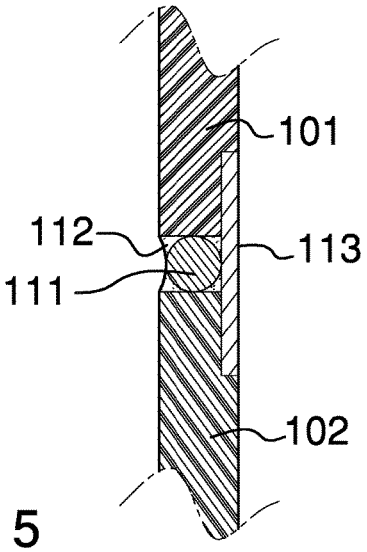
FIG. 5 is a cross-sectional view of an embodiment of the disclosure across 5-5 as shown in FIG. 4.

Detailed reference will now be made to one or more potential embodiments of the disclosure, which are illustrated in FIGS. 1 through 5.

The separable food container 100 (hereinafter invention) comprises a first tube 101, a second tube 102, a fastener 103, a first cap 104 and a second cap 105. The invention 100 is a cylindrical device that is adapted for use in storing a foodstuff 151. The invention 100 comprises a first tube 101, a second tube 102 and a fastener 103. The fastener 103 attaches the first tube 101 and the second tube 102 such that the first tube 101 and the second tube 102 are separable. The advantage of separating the first tube 101 from the second tube 102 is such that when a portion of the foodstuff 151 has been removed, the fastener 103 can be removed thereby separating the first tube 101 from the second tube 102. By removing the portion of the invention 100 that no longer contains a foodstuff 151, access to the remaining foodstuff 151 stored within the invention 100 is simplified.

The first tube 101 is a first hollow cylindrical tube that is further defined with a first end 141 and a second end 142. The second tube 102 is a second hollow cylindrical capped tube that is further defined with a third end 143 and a fourth end 144. The inner diameter of the first tube 101 and the inner diameter of the second tube 102 are congruent. The outer diameter of the first tube 101 and the outer diameter of the second tube 102 are congruent.

The fourth end 144 of the second tube 102 is the capped end. The fourth end 144 of the second tube 102 is capped with the second cap 105. The second cap 105 is permanently attached to the fourth end 144 in the sense that the second cap 105 is not intended to be removable in a replaceable manner.

The first end 141 of the first tube 101 is enclosed with a first cap 104. The first cap 104 is a disk shaped structure that is formed like a capped tube. The inner diameter of the first cap 104 is the same as the outer diameter of the first tube 101 such that the first end 141 of the first tube 101 can be enclosed via inserting the first end 141 into the first cap 104. The first cap 104 is formed from an elastic material, such as a plastic, such that the first cap 104 will be deformed as the first cap 104 is placed over the first end 141 of the first tube 101. As the first end 141 attempt to return to a relaxed shape, a gas impermeable seal is formed between the first cap 104 and the first end 141 of the first tube 101 that protects the foodstuff 151 during storage.

The fastener 103 is a device that attaches the second end 142 of the first tube 101 to the third end 143 of the second tube 102. As shown most clearly in FIG. 5, the fastener 103 comprises a cord 111, an adhesive 112, and a tab 113. The cord 111 is further defined with a fifth end 145 and a sixth end 146. The tab 113 is attached to the fifth end 145 of the cord 111. The cord 111 attaches to the first tube 101 and the second tube 102 using the adhesive 112.

In the first potential embodiment of the disclosure, the second end 142 of the first tube 101 attaches to the third end 143 of the second tube 102 by attaching the second end 142 of the first tube 101 to the third end 143 of the second tube 102 such that: 1) the perimeter of the second end 142 is aligned with the perimeter of the third end 143; and, 2) the cord 111 is positioned between the perimeter of the second end 142 and the perimeter of the third end 143 such that the cord 111 is positioned between the first tube 101 and the second tube 102. Once the adhesive 112 has cured, the invention 100 is ready for storing a foodstuff 151.

In a second potential embodiment of the disclosure, the first end 141 of the first tube 101 is further fitted with a third cap 106 that fits underneath the first cap 104. In this scenario, the third cap 106 is a pull tab can lid 121. Pull tab can lids 121 are well known by those skilled in the food processing and manufacturing arts. Pull can tab lids 121 are commonly used with canned meat products and canned nut products. Alternatively, in a third potential embodiment of the disclosure the third cap 106 is a sheeting 122 selected from the group consisting of a metal foil sheeting or a plastic sheeting. The sheeting 122 is sealed to the first end 141 such that the sheeting 122 forms a gas impermeable seal that maintains the freshness of the foodstuff 151. Methods to attach sheetings 122 to tubes are well known by those skilled in the food processing and manufacturing arts. The use of sheetings 122 as a closure is commonly associated with breadcrumb products and a popular manufactured food product that resembles a potato chip.

To use the invention 100, the first cap 104 and the third cap 106 are removed and the foodstuff 151 contained within the interior of the invention 100 is consumed. When enough of the foodstuff 151 is consumed to make this next step practicable, the tab 113 of the fastener 103 is pulled removing the cord 111 from between the first tube 101 and the second tube 102. The removal of the cord 111 will disrupt the adhesion provided by the adhesive 112 thereby releasing the first tube 101 from the second tube 102. The foodstuff 151 remains in the second tube 102. When the immediately required quantity of the foodstuff 151 is consumed, the second tube 102 can be sealed using the first cap 104 in the same manner as was used to cap the first tube 101.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Capped Tube: As used in this disclosure, a capped tube is a tube with one closed end and one open end.

Congruent: As used in this disclosure, congruent is a term that compares a first object to a second object. Specifically, two objects are said to be congruent when the perimeter, diameter, or shape of the first object can be superimposed over the perimeter, diameter, or shape of the second object such that the perimeter, diameter, or shape of the first object coincides, within manufacturing tolerances, with the perimeter, diameter, or shape of the second object Cord: As used in this disclosure, a cord is a long, thin, and flexible piece of string, line, or rope. Cords are made from yarns, piles, or strands of material that are braided or twisted together or from a monofilament (such as fishing line). Cords have tensile strength but are too flexible to provide compressive strength and are not suitable for use in pushing objects. String, line, and rope are synonyms for cord.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. In this disclosure, the term cylinder specifically means a right cylinder, which is defined as a cylinder wherein the curved surface perpendicularly intersects with the two identical flat and parallel ends.

Diameter: As used in this disclosure, a diameter of an object is a straight-line segment that passes through the center of an object. The line segment of the diameter is terminated at the perimeter or boundary of the object through which the line segment of the diameter runs.

Disk: As used in this disclosure, a disk is a cylindrically shaped object that is flat in appearance.

Elastic: As used in this disclosure, an elastic is a material or object that deforms when a force is applied to it and that is able to return to its original shape after the force is removed. A material that exhibits these qualities is also referred to as an elastomeric material.

Fastener: As used in this disclosure, a fastener is a device that is used to join or affix two objects.

Inner Diameter: As used in this disclosure, the term inner diameter is used in the same way that a plumber would refer to the inner diameter of a pipe.

Interior: As used in this disclosure, the interior is use as a relational term that implies that an object is contained within the boundary of a structure or a space.

Outer Diameter: As used in this disclosure, the term outer diameter is used in the same way that a plumber would refer to the outer diameter of a pipe.

Perimeter: As used in this disclosure, a perimeter is one or more curved or straight lines that binds an enclosed area on a plane or surface. The perimeter of a circle is commonly referred to as a circumference.

Relaxed Shape: As used in this disclosure, a structure is considered to be in its relaxed state when no shear, strain, or torsional forces are being applied to the structure.

Sheeting: As used in this disclosure, sheeting is a material, such as cloth, plastic, or metal foils, in the form of a thin flexible layer or layers.

Tab: As used in this disclosure, a tab is a first object that is attached to a second object for the purpose of: facilitating the manipulation of the second object; or, 2) identification of the second object.

Tube: As used in this disclosure, a tube is a hollow cylindrical device that is used for transporting liquids and gasses. The line that connects the center of the first base of the cylinder to the center of the second base of the cylinder is referred to as the axis of the cylinder or the centerline of the tube. In this disclosure, the terms inner dimension of a tube and outer dimension of a tube are used as they would be used by those skilled in the plumbing arts.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A container comprising:

a first tube, a second tube, a fastener, a first cap and a second cap;

wherein the container is a cylindrical device that is adapted for use in storing a foodstuff;

wherein the fastener attaches the first tube to the second tube;

wherein the first tube and the second tube are separable by removing the fastener;

wherein the first tube is a first hollow cylindrical tube that is further defined with a first end and a second end;

wherein the second tube is a second hollow cylindrical capped tube that is further defined with a third end and a fourth end;

wherein the inner diameter of the first tube and the inner diameter of the second tube are congruent;

wherein the outer diameter of the first tube and the outer diameter of the second tube are congruent;

wherein the fourth end of the second tube is the capped end;

wherein the fourth end of the second tube is capped with the second cap;

wherein the second cap is permanently attached to the fourth end;

wherein the first end of the first tube is enclosed with the first cap;

wherein the first cap is a disk shaped structure that is formed from a capped tube;

wherein the inner diameter of the first cap is the same as the outer diameter of the first tube;

wherein the first end of the first tube is enclosed by inserting the first end into the first cap;

wherein the first cap is formed from an elastic material;

wherein the first cap is deformed as the first cap is placed over the first end of the first tube;

wherein the first cap forms a gas impermeable seal at the first end of the first tube;

wherein the container further comprises a third cap;

wherein the third cap further encloses the first end of the first tube;

wherein the third cap is a pull tab can lid.

2. The container according to claim 1 wherein the fastener attaches the second end of the first tube to the third end of the second tube.

3. The container according to claim 2 the fastener comprises a cord, an adhesive, and a tab;

wherein the cord is further defined with a fifth end and a sixth end;

wherein the tab is attached to the fifth end of the cord;

wherein the cord attaches to the first tube and the second tube using the adhesive.

4. The container according to claim 3 wherein the adhesive attaches the second end of the first tube to the third end of the second tube.

5. The container according to claim 4 wherein the second end of the first tube attaches to the third end of the second tube such that the perimeter of the second end is aligned with the perimeter of the third end.

6. The container according to claim 5 wherein the cord is positioned between the perimeter of the second end and the perimeter of the third end such that the cord is positioned between the first tube and the second tube.

7. The container according to claim 6 wherein the tab of the fastener is pulled such that the cord is removed from between the first tube and the second tube.

8. The container according to claim 7 wherein the removal of the cord disrupts the adhesion provided by the adhesive thereby releasing the first tube from the second tube.

9. The container according to claim 8 wherein the first cap encloses the third end once the first tube is removed from the second tube.

10. The container according to claim 9 wherein the third cap is a sheeting.

11. The container according to claim 10 wherein the sheeting is formed from plastic.

12. The container according to claim 10 wherein the sheeting is formed from a metal foil.

* * * * *